US007556513B2

(12) United States Patent
Ng et al.

(10) Patent No.: US 7,556,513 B2
(45) Date of Patent: Jul. 7, 2009

(54) COMPACT SHUTTER ASSEMBLY FOR RECEPTACLE

(75) Inventors: Kenneth Yat Chung Ng, Los Angeles, CA (US); Edmund Yat Kwong Ng, Los Angeles, CA (US)

(73) Assignee: Koncept Technologies Inc., Monterey Park, CA (US)

( * ) Notice: Subject to any disclaimer, the term of this patent is extended or adjusted under 35 U.S.C. 154(b) by 0 days.

(21) Appl. No.: 12/029,419

(22) Filed: Feb. 11, 2008

(65) Prior Publication Data

US 2008/0194128 A1 Aug. 14, 2008

Related U.S. Application Data

(60) Provisional application No. 60/900,856, filed on Feb. 12, 2007.

(51) Int. Cl.
*H01R 13/44* (2006.01)

(52) U.S. Cl. ..... 439/137

(58) Field of Classification Search ..... 439/137, 439/139, 145

See application file for complete search history.

(56) References Cited

U.S. PATENT DOCUMENTS 3,222,631 A 12/1965 Cohen
4,379,607 A 4/1983 Bowden, Jr.
4,707,042 A 11/1987 Haden
4,722,693 A 2/1988 Rose
4,867,693 A 9/1989 Gizienski et al.
4,867,694 A 9/1989 Short
5,020,997 A 6/1991 Calderara et al.
5,624,270 A 4/1997 Blanchot et al.
5,702,259 A 12/1997 Lee
5,915,981 A 6/1999 Mehta
6,086,391 A 7/2000 Chiu
6,422,880 B1 7/2002 Chiu
6,786,745 B1 * 9/2004 Huang ..... 439/137
6,893,275 B2 5/2005 Ng et al.

FOREIGN PATENT DOCUMENTS

GB 2 199 996 A 7/1988

* cited by examiner

*Primary Examiner*—Neil Abrams
(74) *Attorney, Agent, or Firm*—Foley & Lardner LLP

(57) ABSTRACT

A shutter assembly for a receptacle including a plate, a card disposed adjacent the plate, a shutter disposed between the plate and the card, a first biasing member for providing lateral movement of the shutter, the first biasing member abutting a first extension of the plate; a second biasing member for providing transverse movement of the shutter, the second biasing member for providing a first pivot point to the shutter; and one or more protrusions for providing a second and/or third pivot point to the shutter, the protrusions disposed between the plate and the shutter. In one example the receptacle may be an AC outlet.

15 Claims, 15 Drawing Sheets

COMPACT SHUTTER ASSEMBLY FOR RECEPTACLE

CROSS-REFERENCE TO RELATED PATENT APPLICATIONS

Priority is claimed from U.S. Provisional Application No. 60/900,856, filed Feb. 12, 2007 including the specification, drawings and abstract, is incorporated herein by reference in its entirety.

BACKGROUND OF THE INVENTION

The present invention relates to shutter assemblies for electrical receptacles and electrical receptacles incorporating such shutter assemblies. Particular embodiments relate to shutter assemblies that may prevent access to electrical receptacles, such as but not limited to common household AC outlets.

Virtually every household in the industrialized world is equipped with sockets outlets or receptacles supplying electrical power. Electrical power is generally considered a necessity and, thus, virtually no modern home is ever designed without access to electrical power. Moreover, with the rapid increase in the number of electrical and electronic products in a typical home, power strips employing multiple power outlets have become commonplace, resulting in an increase in the number of electrical power outlets in the typical, modern home.

In addition, the increase in the number of electrical and electronic products in the typical home has increased not only the number of power outlets in the home, but also the number of electronic sockets and receptacles generally. Computers, stereo equipment, DVD players, television sets and the like are replete with plugs, pins, receptacles and sockets that must mate for effective operation of the equipment.

The natural curiosity of children can make the common household power outlet a dangerous device. Although children may not likely insert a standard three-prong plug of an electrical device into a wall outlet, it is not uncommon for a child to insert a single metal object, such as, for example, a key or a paper clip, into a wall outlet. Given the high voltage that typically exists in a common AC power outlet, such a scenario could be dangerous or even deadly. When children attempt to insert metal objects into computer or entertainment equipment receptacles, damage to the device may result.

Several attempts have been made in the prior art to preclude unwanted insertion of objects into power outlets. Some prior art devices employ a shutter plate that locks (Plurality of stop surfaces) when a single pin is inserted into the outlet. However, in these devices, the normal position of the shutter plate is in an unlocked position. Thus, by carefully inserting a pin into the outlet, or by just being lucky (or, more accurately, unlucky), the shutter plate may be subverted and the safety of the device compromised.

Other prior art devices have employed multiple shutters to prevent unwanted access to power outlets. However, in electrical sockets, the distance between the front surface of the socket to the electrical contact inside the socket is limited. Thus, multiple shutters must share this limited space, and performance may be compromised. In addition, because multiple shutters of some prior art devices have relatively large contact surfaces, relatively large amounts of friction is generated when the shutters slide as a result of plugs being inserted into the socket and against the contact surfaces. As a result, the contact surfaces and other surfaces can wear out quickly, especially when plugs with relatively sharp edges are inserted into the socket.

SUMMARY OF THE DISCLOSURE

One embodiment of the present invention provides a shutter assembly that prevents unwanted, undesired or improper access to receptacles. Another embodiment of the present invention provides a shutter assembly that prevents unwanted, undesired or improper insertion of a single pin into a variety of outlets. Another embodiment of the present invention provides a shutter assembly that can be inserted interchangeably into various different cover plate designs.

Embodiments of the present invention relate to the subject matter described and illustrated in U.S. Pat. No. 6,893,275 granted to Kenneth Ng et al. on May 17, 2005, which is incorporated herein by reference, in its entirety. Embodiments described herein may employ a dowel (Pivot structure) instead of a moveable plunger, to help minimize the number of moveable parts. Fewer parts and fewer moveable parts can help reduce the cost of production and the size of the assembly. Reduction in parts can provide a significant reduction in size, allowing one embodiment to be fitted in any common household socket without having to replace the outer wall plate. Further embodiments of the present invention also add a door like card (Front plate) that seals the contents of the entire assembly making the assembly secure.

According to other embodiments of the present invention, a shutter assembly for a receptacle may include a plate, a card disposed adjacent the plate, a shutter disposed between the plate and the card, a first spring for providing lateral movement of the shutter, the first spring abutting a first extension of the plate; a second spring for providing transverse movement of the shutter, the second spring providing a first pivot point to the shutter; and one or more protrusions for providing a second and/or third pivot point to the shutter, the protrusions disposed between the plate and the shutter. In one example the receptacle may be an AC outlet. In another example, the receptacle may be a phone jack, USB jack, DC outlet, Ethernet socket or any other type of power outlet.

According to an embodiment of the present invention, the plate and shutter may include a plurality of apertures for accepting pins. The pins may be AC plug pins, DC plug pins, USB device, an Ethernet jack pins, phone jack pins, or any other type of power outlet.

The shutter may include a first angled surface, a second angled surface, and an aperture, the aperture disposed between the first angled surface and the second angled surface. In a first position (first pivot position) of the shutter, the first angled surface may be aligned with one of the plurality of apertures of the plate and the second angled surface may be aligned with another of the plurality of apertures of the plate.

The card may further include a second lock (Stop surface), and the plate may further include a first lock, a third lock and a fourth lock. The shutter may further include a first lug (Stop surface), a second lug, a third lug and a fourth lug (Plurality of stop surfaces). When the shutter is in the first position, the first lug may abut the first lock and the second lug may abut the second lock.

In another embodiment of the present invention, the card may include a first and second lock, and the plate may further include a third lock and a fourth lock.

In a second position of the shutter, the aperture of the shutter may align with one of the plurality of apertures of the plate as pins are inserted, the pins being simultaneously inserted against the first angled surface and the second angled surface. The shutter may compress the first spring when the shutter is in the second position. The second spring may cause the first lug and the second lug to abut the first lock and the second lock when the shutter is in the first position.

The shutter may pivot about the second spring when one pin is inserted against one of the angled surfaces of the shutter. The first lug may abut the first lock when the shutter pivots about the dowel. The second lug may abut the second lock when the shutter pivots about the dowel. The third lug may abut the third lock when the shutter pivots about the dowel. The fourth lug may abut the fourth lock when the shutter pivots about the dowel.

In further embodiments, the shutter may cover the plurality of apertures of the plate when the shutter is in the first position. The shutter may remain in the first position when only one pin is inserted against the angled surface of the shutter.

The second spring may include a plurality of springs. The second lock may be a protrusion of the card. The second lock may be attached to the card. The first lock and the third lock and the fourth lock may be protrusions of the plate. The first lock and the third lock and the fourth lock may attach to the plate. The plate may further include a compartment for housing the second spring.

DETAILED DESCRIPTION OF THE EMBODIMENTS

In the following description of preferred embodiments, reference is made to the accompanying drawings which form a part hereof and in which are shown by way of illustration specific embodiments in which the invention may be practiced. It is to be understood that other embodiments may be utilized and structural changes may be made without departing from the scope of the preferred embodiments of the present invention.

Although the following description is directed primarily to an AC voltage outlet commonly found in homes and offices, shutter assemblies according to embodiments of the present invention may be used in any receptacle for which the prevention of unwanted or improper access is desired. For example, shutter assemblies according to embodiments of the present invention may be used in receptacles in electrical or electronic equipment such as computers, stereo equipment, DVD players, VCRs, musical equipment and the like.

Figure 1A:
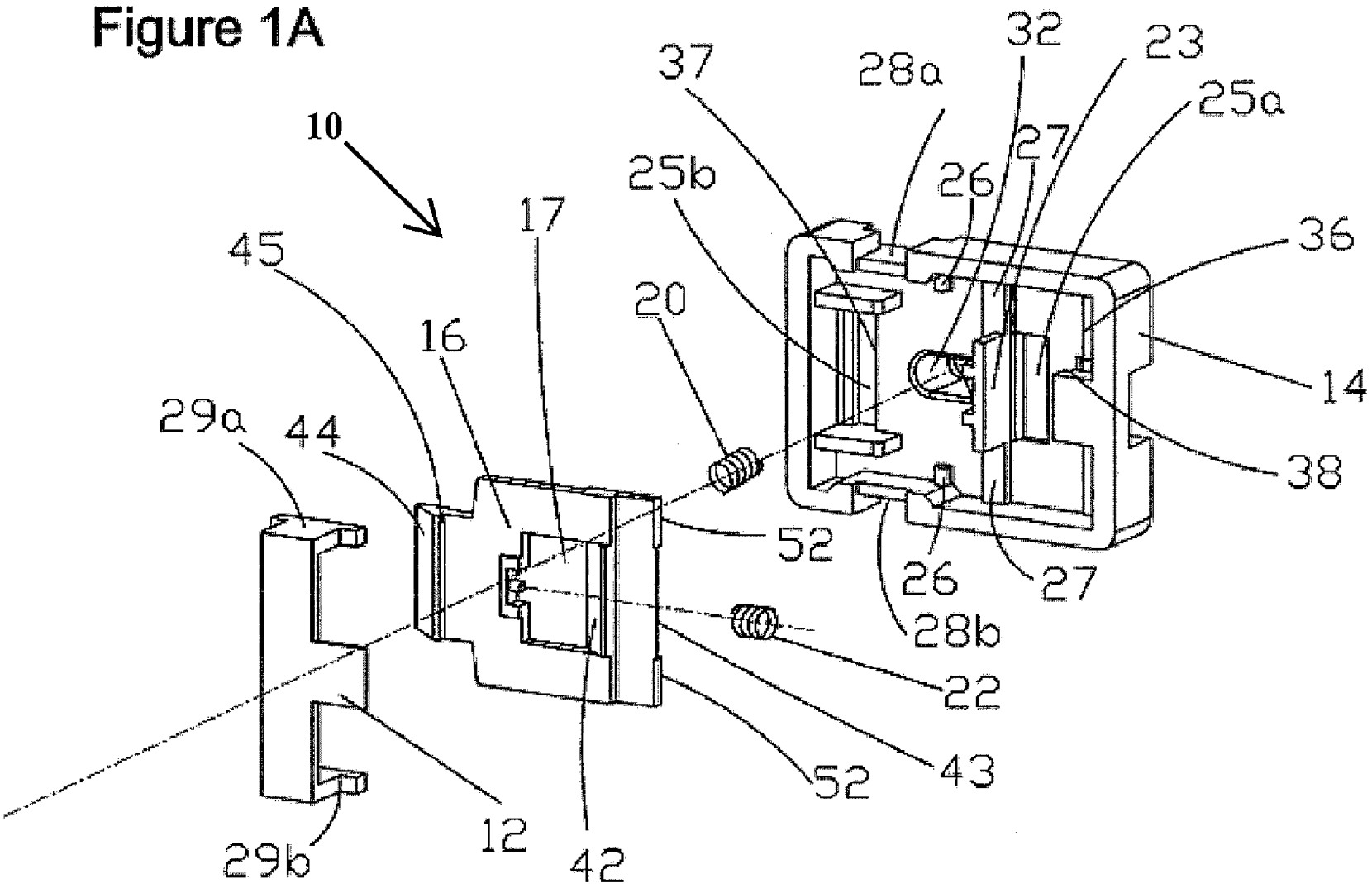
FIG. 1A shows an exploded frontal view of a shutter assembly according to an embodiment of the present invention.
Figure 1B:
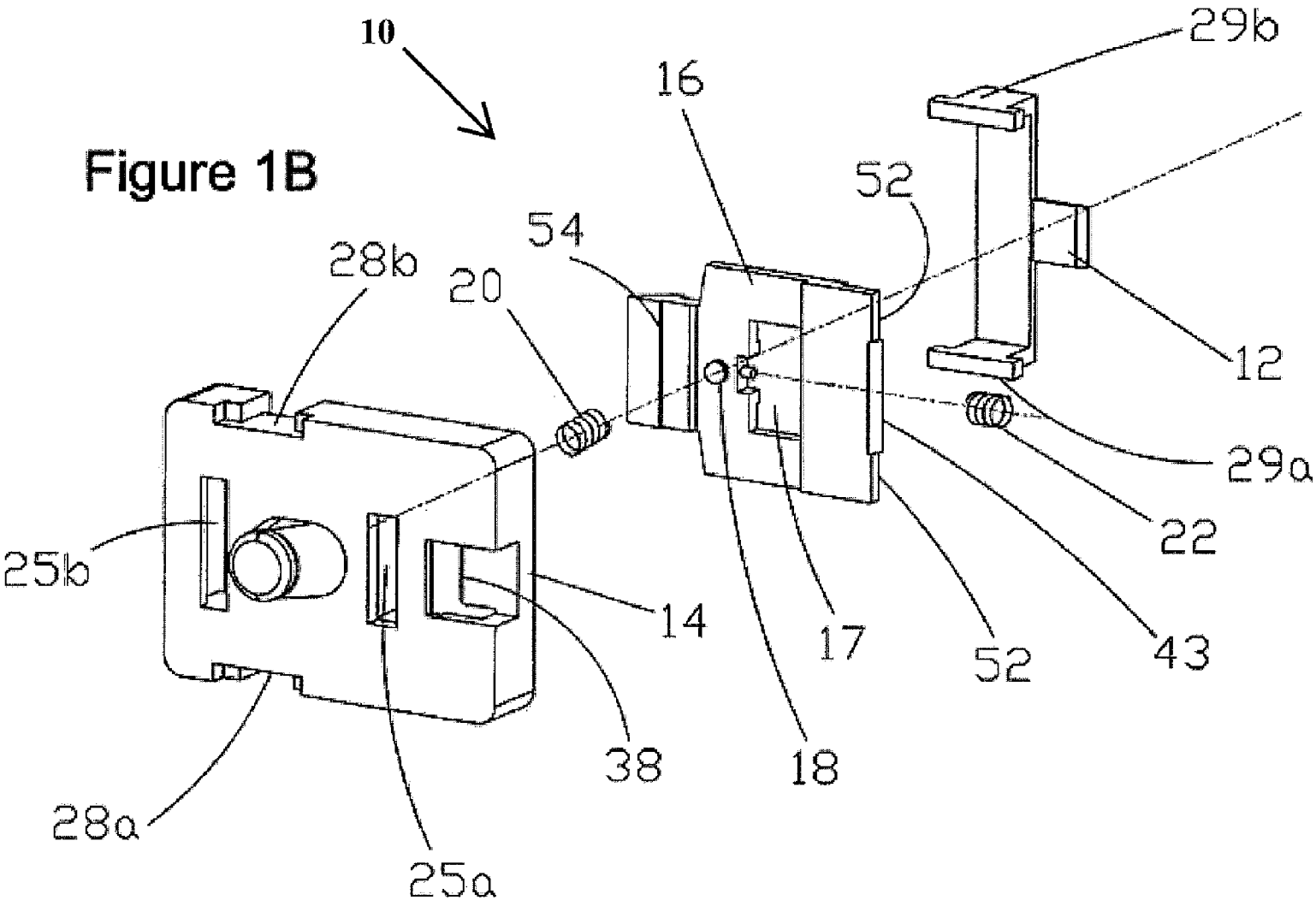
FIG. 1B shows an exploded rear view of the shutter assembly from FIG 1A according to an embodiment of the present invention.
Figure 2:
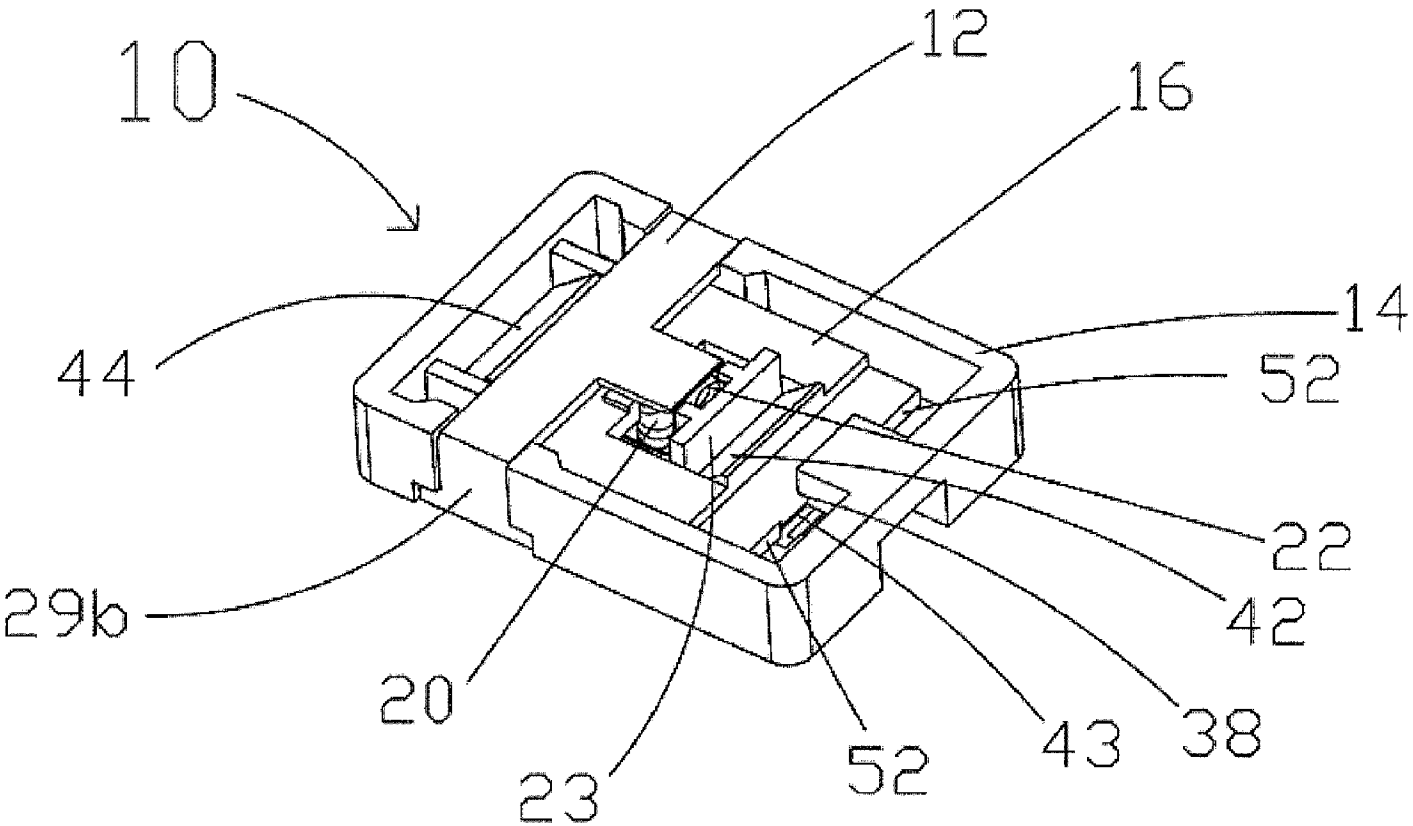
FIG. 2 shows a perspective view of a fully assembled shutter assembly from FIGS. 1A and 1B according to an embodiment of the present invention as a single unitary body.

A shutter assembly 10 according to an embodiment of the present invention is shown in FIGS. 1A and 1B. The shutter assembly 10 includes a card (Front plate) 12, a back plate 14, a shutter 16, one or more dowels (Pivot structure) 18, one or more dowel springs (Second biasing member) 20 and a shutter spring (First biasing member) 22. In yet other embodiments the first and second biasing members can be leaf springs, elastic foams, elastic gels or other materials that provide a biasing force. According to the embodiment of the present invention shown in FIGS. 1A and 1B, the shutter assembly 10 may be used for any type of power outlet including, but not limited to a common household AC outlet.

According to the embodiment of the invention shown in FIGS. 1A and 1B, the card 12 is narrow enough to have the two pins of a AC plug go around it. The card shown in the embodiment of the invention of FIGS. 1A and 1B is configured to accept a standard two-prong AC plug and a standard three-prong AC plug. However, other embodiments of the invention may have the card configured in a variety of other ways in order to accommodate other power outlets. For example, the card may be configured to accept a standard two-prong AC plug, to conform to the characteristics of AC plugs in any country, or to accept the plugs of any type of cable used in a variety of industries. The card may be configured to accept computer plugs, musical equipment plugs and the like.

According to the embodiment of the invention shown in FIGS. 1A and 1B, the card has protruding fasteners 29*a* and 29*b*. The fasteners are useful in adjoining the card 12 with the back plate 14. In addition, the card 12 may include a variety of shafts, pins or brackets that may correspond to guides on the back plate 14, all of which may be used to maintain the position of the shutter 16 when the shutter 16 is disposed between the card 12 and the back plate 14. Once the fasteners 29*a* and 29*b* in card 12 are snapped on to the guides on plate 14 the assembly 10 is complete.

According to an embodiment of the present invention, the back plate 14 includes back plate apertures 25*a* and 25*b*. The back plate apertures 25*a* and 25*b* of the embodiment of the invention shown in FIGS. 1A and 1B are configured to conform to a standard two or three-prong AC plug. The back plate 14 also includes one or more fastener guides 28*a* and 28*b* that serve as a receptacle for the fasteners 29*a* and 29*b* of the card 12 when adjoining the card 12 and the back plate 14.

According to another embodiment of the present invention, the back plate 14 may contain the fasteners 29*a* and 29*b* and the card 12 may contain the fastener guides 28*a* and 28*b*. Another embodiment may not require the fasteners all together and the card 12 and the back plate 14 may be assembled with another means of assembly.

The back plate 14 may also include one or more dowel spring compartments (Bias member compartment) 32. The spring compartments 32 may be used to provide a place for disposing the one or more dowel springs 20.

The back plate 14 may also include one or more back plate locks 36, 37 and 38 that aid in securing the shutter when undesired, unwanted or improper access to the receptacle is attempted.

The back plate 14 may also include back plate extension 23 that provides a surface against which first spring 22 may compress against. In one embodiment, the extension may be, formed integral with the plate, such as a protrusion on the plate. In another embodiment, the extension may be a separate member that is attached to the plate.

The back plate 14 may also include one or more protrusions 26 that provide a second and/or third pivot point when the shutter 16 is pushed away from the card 12 and toward the plate 14. The protrusion or protrusions on the back plate 14 may be integral to the plate or attached to the plate.

The shutter 16 may include a first angled surface 42 and a second angled surface 44. At the end of the shutter 16, adjacent to the first angled surface 42 is a first lug 43 and a third lug 52. At one end of the second angled surface 44 is a second lug 45 and at the other end of the second angled surface 44 is a fourth lug 54. In the embodiment of the invention shown in FIGS. 1A and 1B, the lugs 43 and 52 form an integral part of the end of the shutter 16, the lugs 45 and 54 form an integral part of the second angled surface 44. However, the lugs 43, 45, 52, 54 need not be so formed. The lugs 43, 45, 52, 54 may be formed as another part of the shutter 16 or may be separate parts that are attached or affixed to the shutter 16.

The first angled surface 42 and the second angled surface 44 may be fabricated at a variety of angles. According to embodiments of the present invention, the angle of the first angled surface 42 and the second angled surface 44 may be greater than 45 degree. According to one embodiment of the present invention, the angle of the first angled surface and the second angled surface may be 47 degree. Angles of 45 degree or greater provide for minimal wear on the first angled surface 42 and the second angled surface 44 when pins or plugs are inserted into the shutter assembly 10 and up against the first angled surface 42 and the second angled surface 44.

The shutter 16 also includes at least one shutter aperture 17. The shutter aperture 17 may align with the first back plate aperture 25*a*, as will be explained in more detail below.

According to the embodiment of the invention shown in FIGS. 1A and 1B, the dowel 18 is disposed between the back plate 14 and the shutter 16. The dowel 18 may be a protrusion that is formed integral with the shutter as a single unitary body or is formed as a separate structure that is fixedly attached to the shutter or pressed against the shutter by the dowel spring 20. In this manner, the dowel 18 may be fixed to the shutter 16 and, thus need not be a separate, moveable member with respect to the shutter 16. The dowel 18 may be formed in a triangular shape, a rounded shape, or any shape what will allow the shutter 16 to pivot about the dowel 18. The dowel 18 may alternatively be formed by any method that secures the dowel spring 20 to the shutter 16 to define a fulcrum. The dowel 18 may be formed as a cavity for the dowel spring 20 to be seated in. The dowel 18 may also be formed by molding one end of the dowel spring 20 into the shutter. The dowel 18 may also be formed by gluing the dowel spring 20 to the shutter. The pivoting is facilitated by the force applied by the dowel spring 20, as will be explained in more detail below.

Operation of the shutter assembly 10 when access to the receptacle is desired is described with reference to FIGS. 4-7. In the embodiment of the invention shown in FIGS. 4-5, the card 12 is disposed adjacent to and abuts the back plate 14. Disposed in a hollow area between the card 12 and the back plate 14 is the shutter 16. The dowel spring 20 is disposed in the dowel spring compartment 32 and is configured such that it exerts a force on the dowel 18 and the shutter, which itself is disposed between the dowel spring 20 and the shutter 16. In turn, the dowel exerts a force against the shutter 16 due to the force exerted by the dowel spring 20. When there are no pins present within the shutter assembly 10, there is no force external to the shutter assembly 10 acting on the shutter 16. Thus, the shutter 16 is disposed against the card 12 due to the force acting on it exerted by the dowel spring 20 through the dowel 18.

Figure 3:
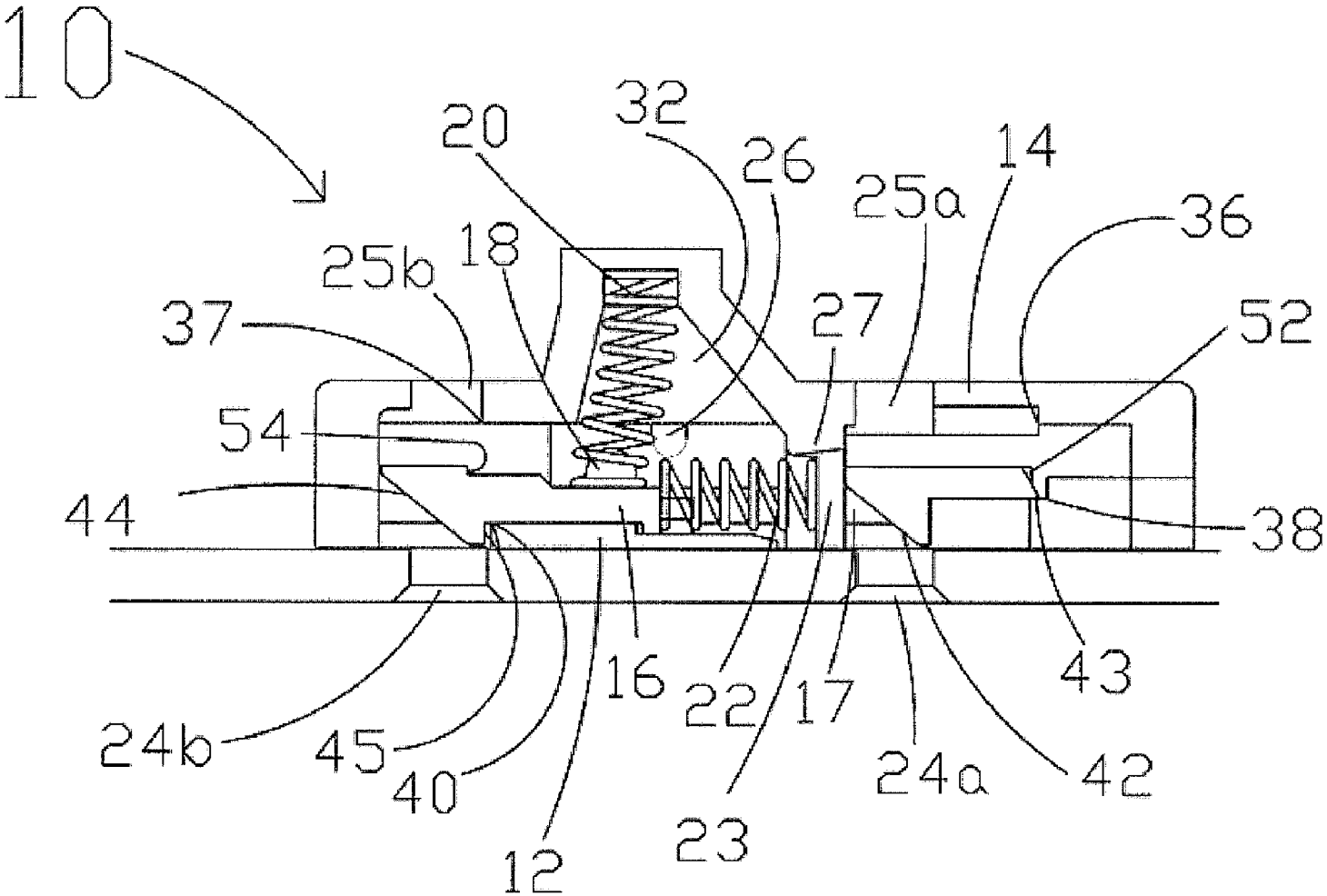
FIG. 3 shows a cutaway plan view of a shutter assembly according to an embodiment of the present invention.

When shutter 16 is in the position shown in FIG. 3, the first lug 43 and the second lug 45 of the shutter 16 abut a first lock 38 and a second lock 40, respectively. The first lock 38 may be fabricated as an integral portion of the plate 14, and the second lock 40 may be fabricated as an integral portion of the card 12. In another embodiment of the present invention, the first lock 38 and the second lock 40 may be fabricated as an integral portion of the card 12. According to another embodiment of the present invention, the first lock 38 and the second lock 40 may be fabricated as separate parts that are affixed or otherwise attached to the card 12, or to the plate 14 and card 12 respectively. As can be seen in FIG. 3, the first lock 38 and the second lock 40 provide resistance for the first lug 43 and the second lug 45, respectively, thereby preventing the shutter 16 from moving toward its open position.

Figure 4:
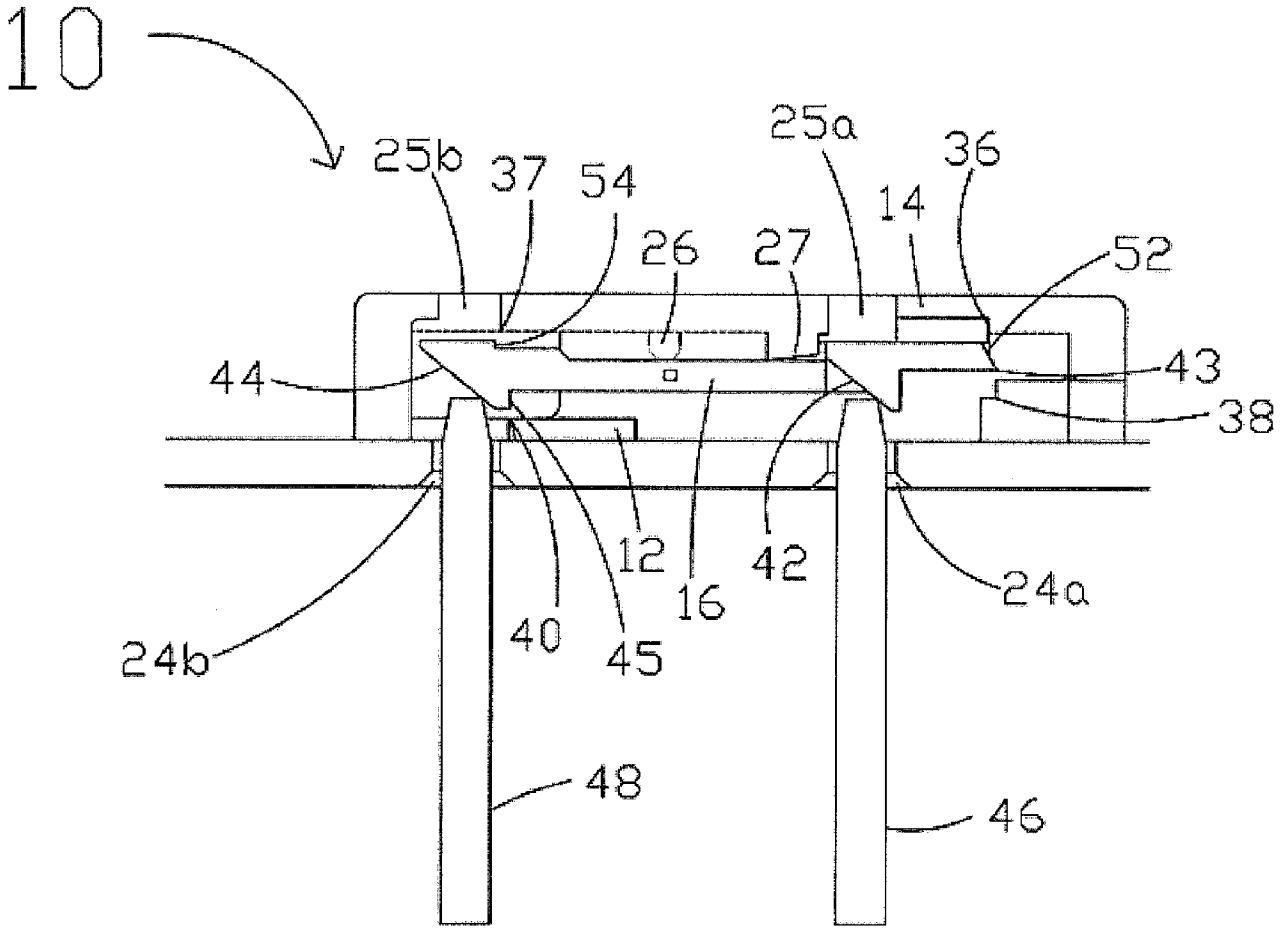
FIG. 4 shows a cutaway plan view of a shutter assembly without the first spring, second spring and the dowel with two pins inserted into the shutter assembly according to an embodiment of the present invention and shows an example of the shutter in a first pivot position.
Figure 5:
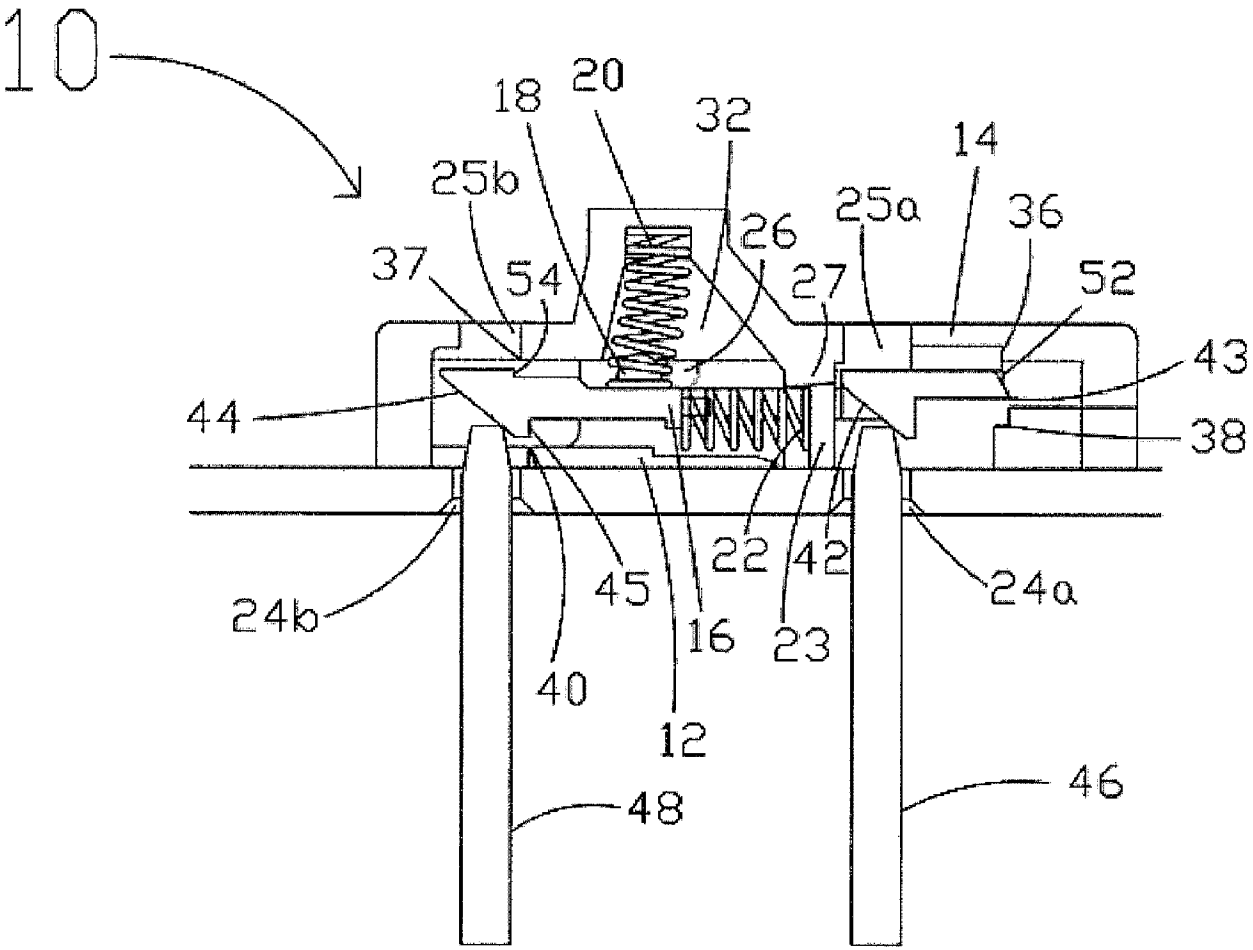
FIG. 5 shows a cutaway plan view of a shutter assembly with two pins inserted into the shutter assembly and the first and second springs compressing according to an embodiment of the present invention and shows an example of the shutter in a first pivot position.
Figure 6:
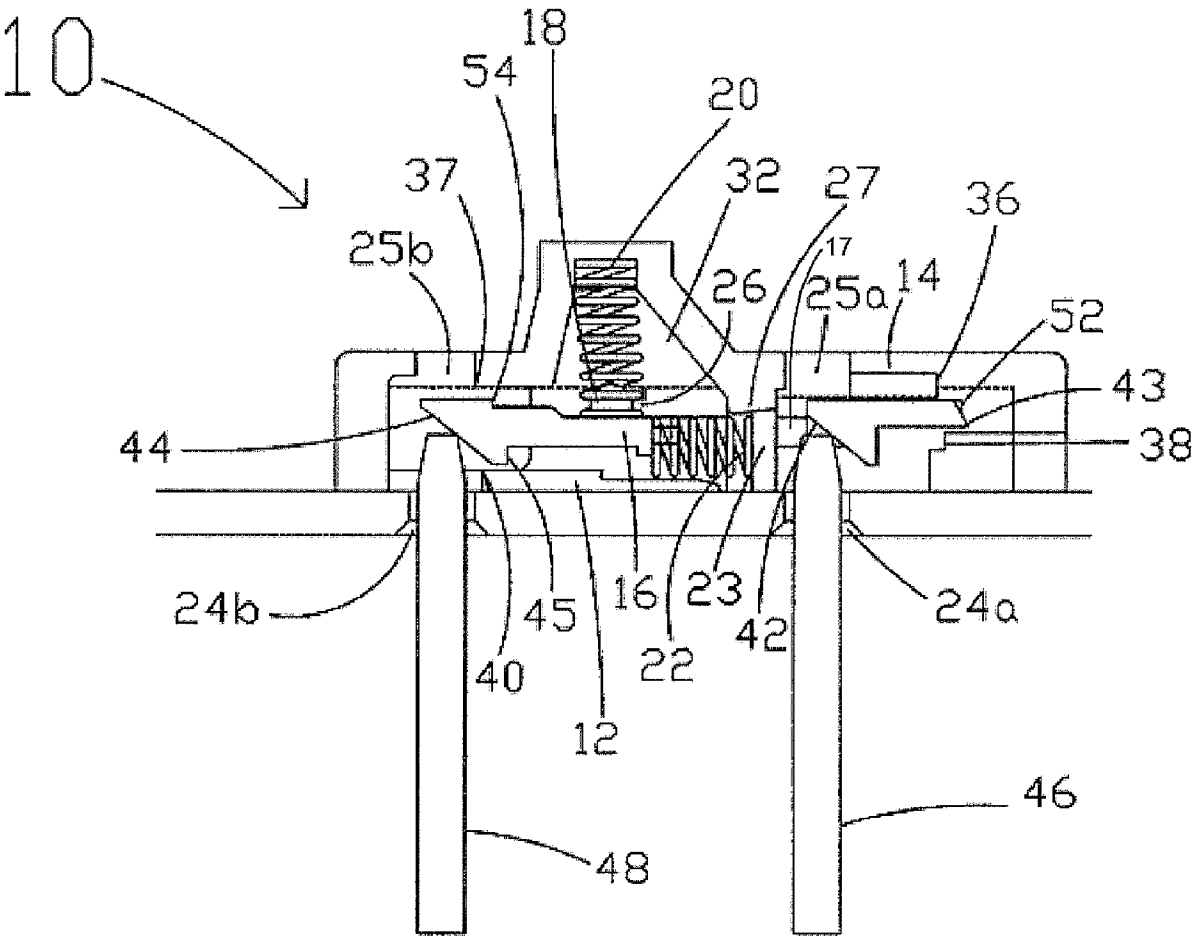
FIG. 6 shows a cutaway plan view of a shutter assembly with two pins inserted further than FIG. 5 into the shutter assembly and the shutter moving laterally to accommodate the pins according to an embodiment of the present invention and shows an example of the shutter in a first pivot position.

However, with reference to FIGS. 4, 5 and 6, when substantially equal force is applied to the first pin 46 and the second pin 48, the first pin 46 and the second pin 48 will simultaneously push against the first angled surface 42 and the second angled surface 44, respectively. In so doing, the first lug 43 and the second lug 45 are pushed away from the first lock 38 and the second lock 40, respectively. When the first lug 43 and the second lug 45 are free from the first lock 38 and the second lock 40, respectively, there is no resistance to the lateral movement of the shutter 16. Also, as the first pin 46 and the second pin 48 are inserted through the wall plate apertures 24*a* and 24*b*, respectively, and pushed against the first angled surface 42 and the second angled surface 44, respectively, the shutter 16, whose lateral movement is not inhibited by the first lock 38 and the second lock 40, moves toward its open position and, if adequate force is applied by the first pin 46 and the second pin 48, the compression of the shutter spring 22 increases as it is forced against the first back plate extension 23.

Figure 7:
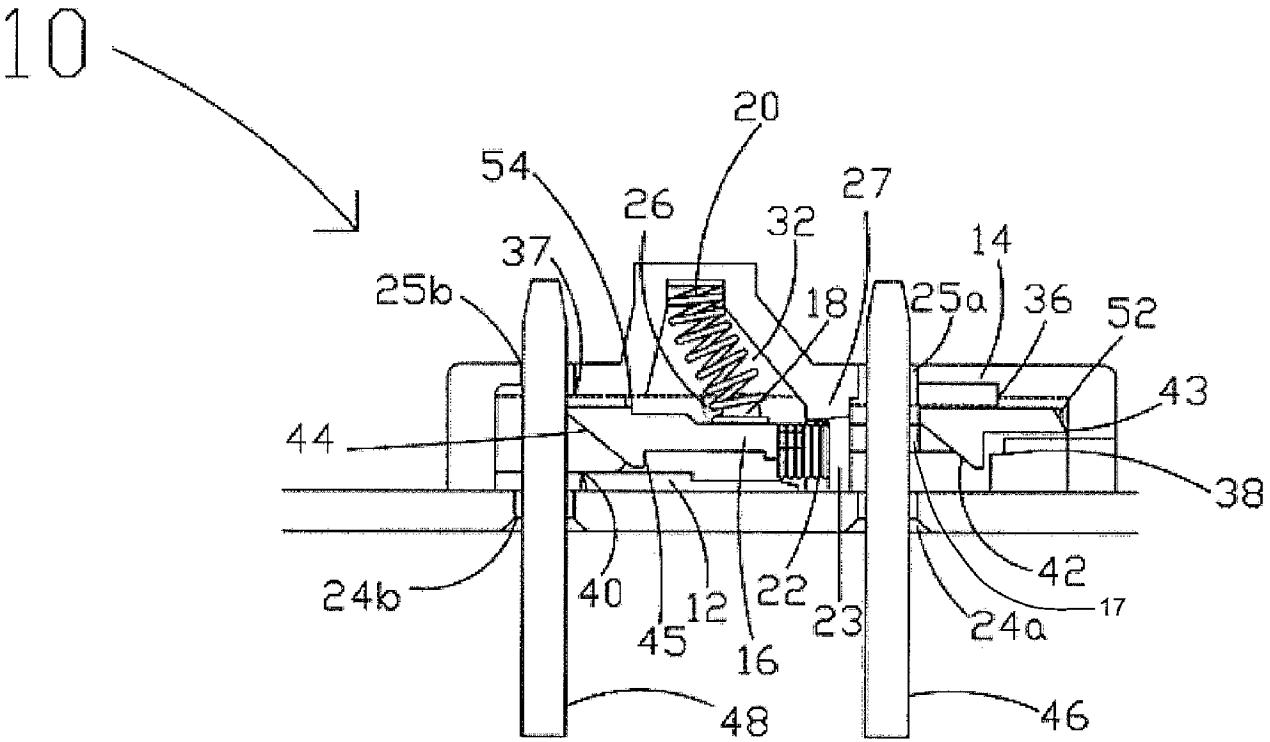
FIG. 7 shows a cutaway plan view of a shutter assembly with two pins inserted through the shutter assembly from FIG. 5 and FIG. 6, and the shutter spring compressing and thereby allowing the shutter to move laterally according to an embodiment of the present invention and shows an example of the shutter in a second pivot position.

Moreover, with reference to FIG. 6, as the shutter 16 moves laterally toward its open position, the shutter aperture 17 aligns itself with the first back plate aperture 25*a* and, simultaneously, the second back plate aperture 25*b* is exposed. Thus, the first pin 46 is free to extend fully through, the shutter aperture 17 and the first back plate aperture 25*a*, as may be seen in FIG. 7. Also, the second pin 48 is free to extend fully through the second back plate aperture 25*b*. In FIG. 7, the shutter spring 22 is compressed. When the first pin 46 and the second pin 48 are removed from the shutter assembly 10, the compression of the shutter spring 22 will force the shutter 16 back into its locked position as shown in FIG. 3.

Figure 8:
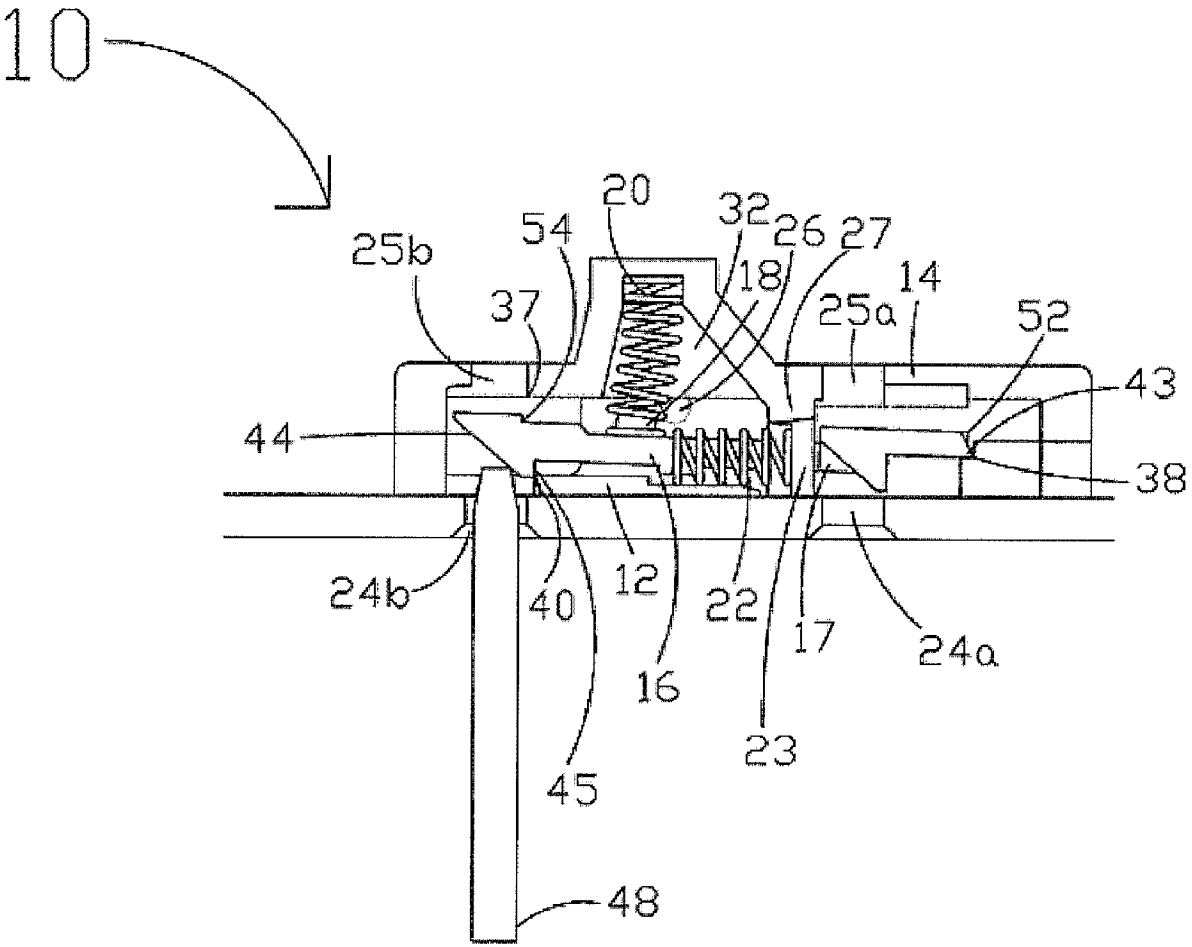
FIG. 8 shows a cutaway plan view of a shutter assembly with one pin inserted into the shutter assembly and the locks beginning to engage to prevent the pin from going through the back plate aperture and forming an electrical connection, according to an embodiment of the present invention and shows an example of the shutter in a first pivot position.
Figure 9:
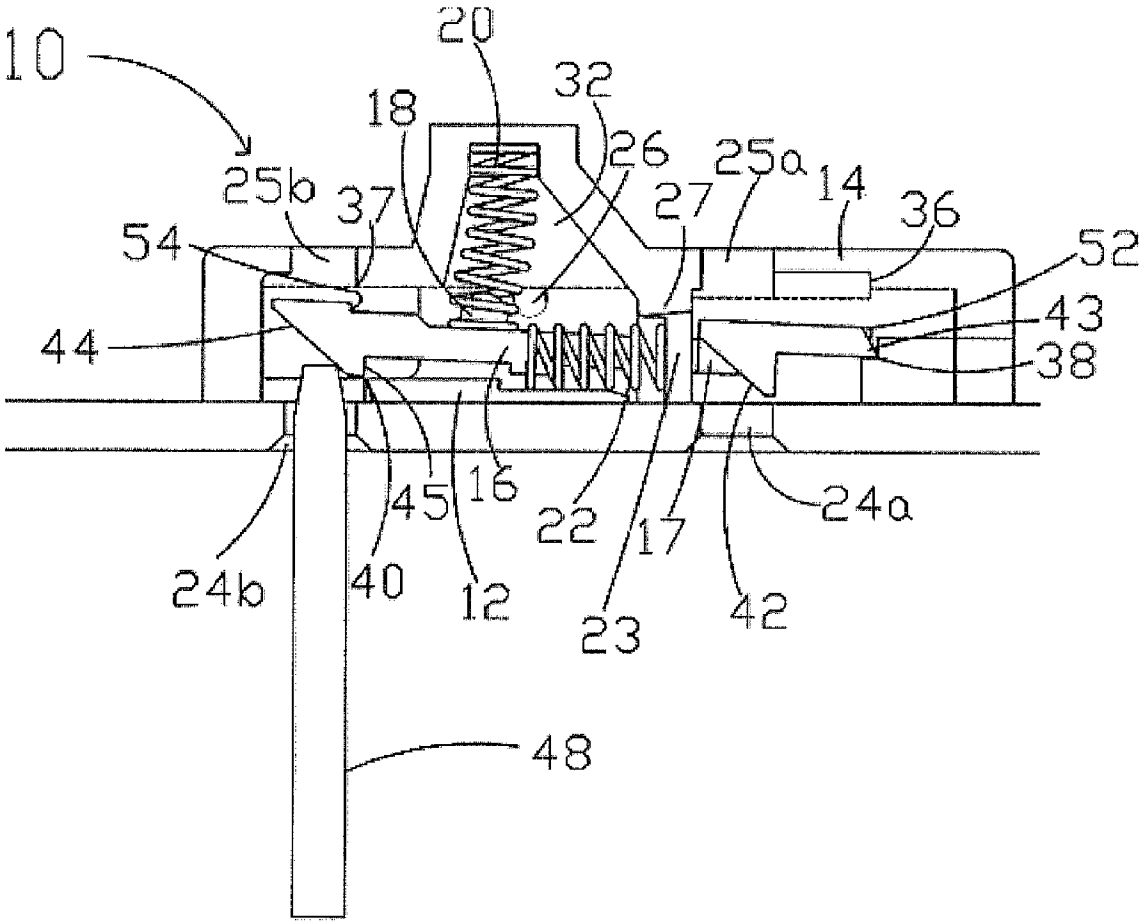
FIG. 9 shows a cutaway plan view of a shutter assembly from FIG. 8 with one pin inserted into the shutter assembly and one of the locks engaging according to an embodiment of the present invention and shows an example of the shutter in the first pivot position.
Figure 10:
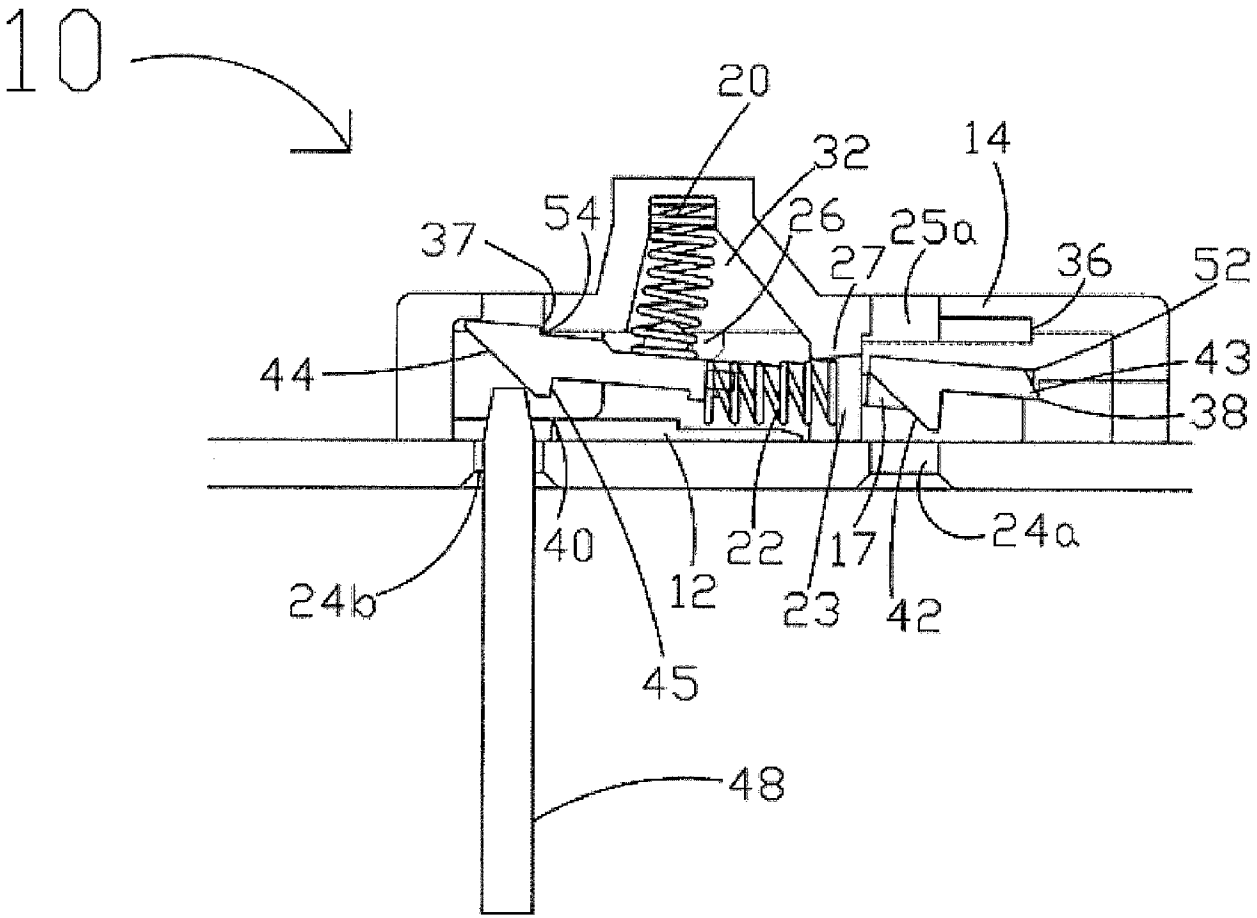
FIG. 10 shows a cutaway plan view of a shutter assembly from FIG. 9 with one pin inserted into the shutter assembly and two of the locks engaging according to an embodiment of the present invention and shows an example of the shutter in the first pivot position.

Operation of the shutter assembly 10 when entry into a receptacle is unwanted, undesired or improper is described with reference to FIGS. 8-13. In FIG. 8, the second pin 48 only is inserted into the second wall plate aperture 24*b*. This situation may be reminiscent, for example, of a child trying to stick a key or other object into one of the apertures of an AC outlet. In FIG. 8, as the second pin 48 extends through the second wall plate aperture 24*b*, the force exerted by the second pin 48 on the second angled surface 44 causes the shutter 16 to pivot about the dowel 18. Thus, although the second lug 45 is forced away from the second lock 40, the first lug 43 is forced by the dowel to maintain its position against the first lock 38. The fourth lug 54 is then forced to the position against the fourth lock 37 as seen in FIG. 10. In this position, the protrusions 26 act as a hard pivot point for shutter 16 so that the more force is used to push in second pin 48, the more securely lugs 43 and 54 are secured in locks 38 and 37 respectively. Thus, the shutter 16 is prevented from moving laterally toward its open position, not granting access to the first and second back plate apertures 25*a* and 25*b* respectively, and the receptacle.

Figure 11:
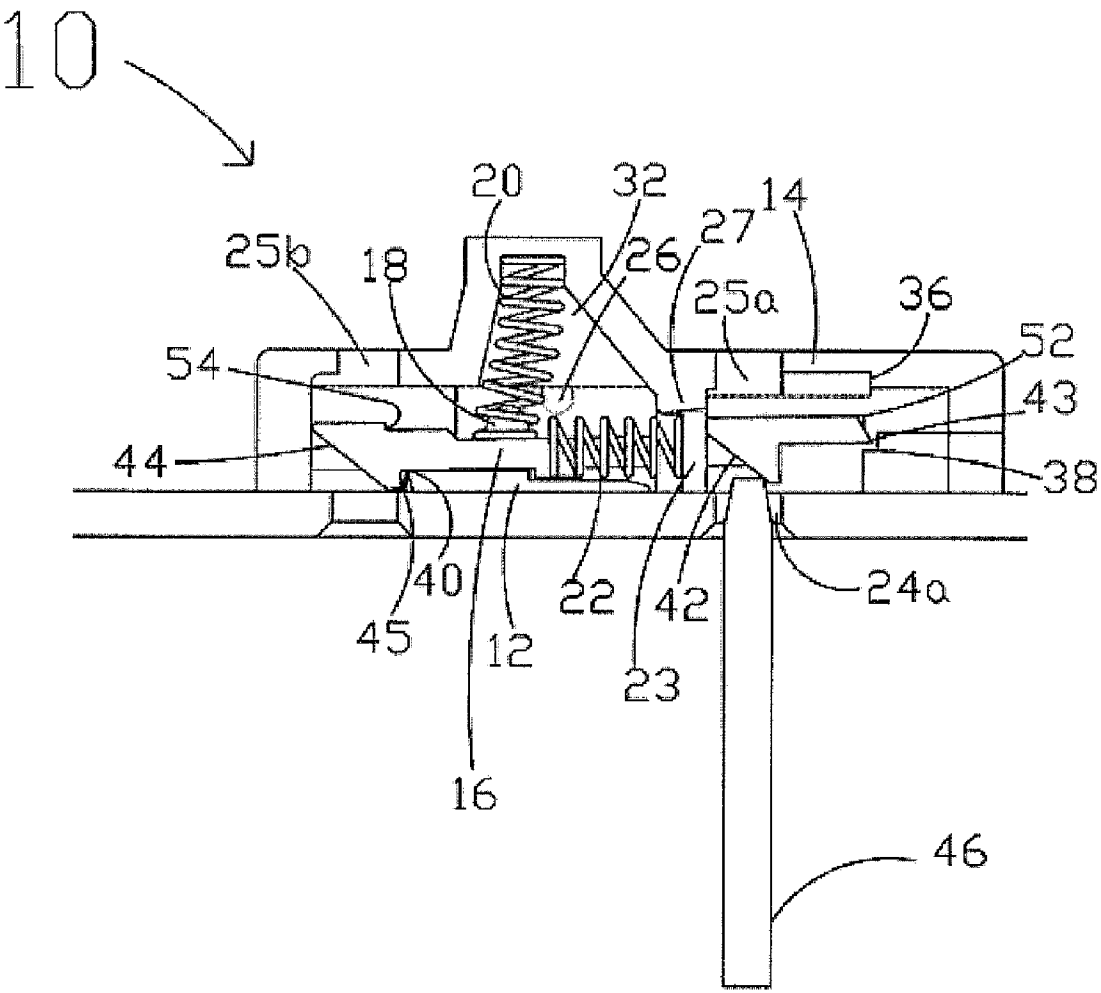
FIG. 11 shows a cutaway plan view of a shutter assembly with a second pin inserted into the shutter assembly and one lock engaging according to an embodiment of the present invention and shows an example of the shutter in the first pivot position.
Figure 12:
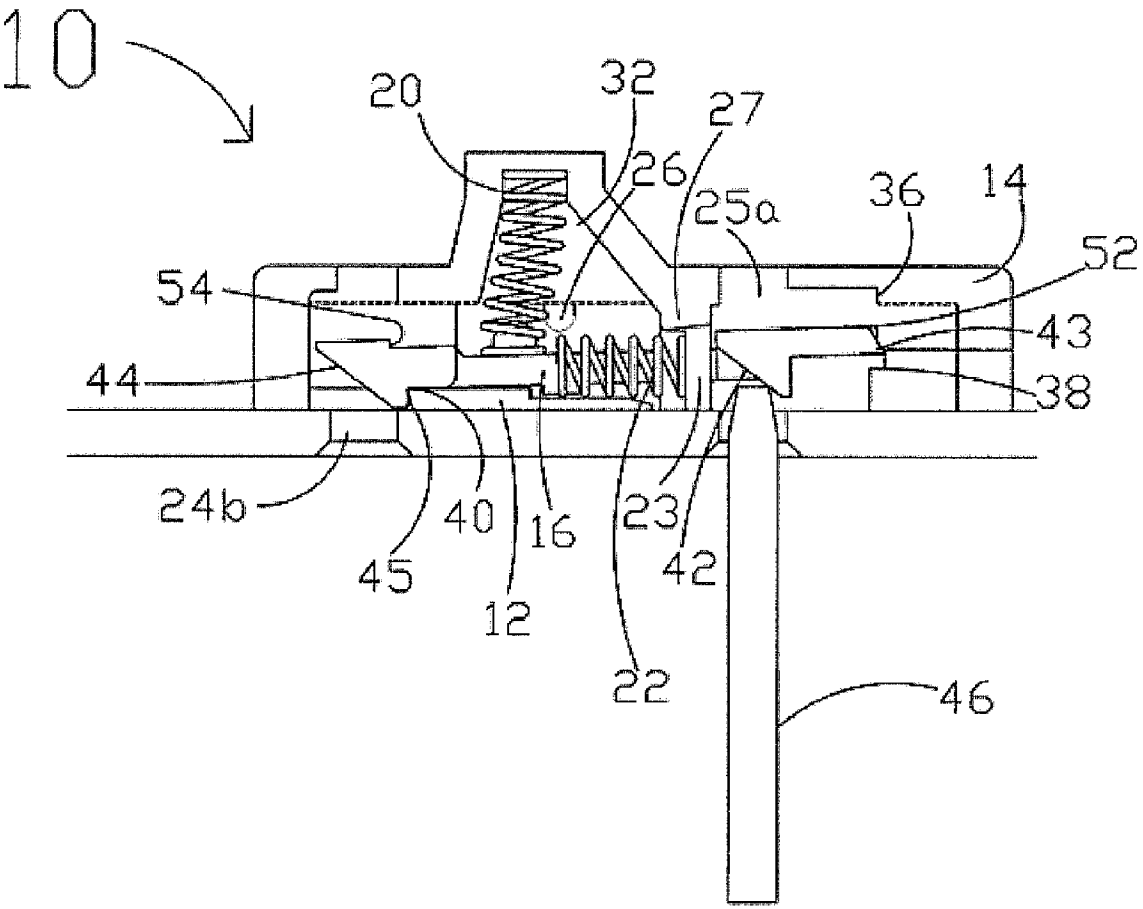
FIG. 12 shows a cutaway plan view of a shutter assembly from FIG. 11 with a second pin inserted into the shutter assembly and one lock engaging according to an embodiment of the present invention and shows an example of the shutter in the first pivot position.
Figure 13:
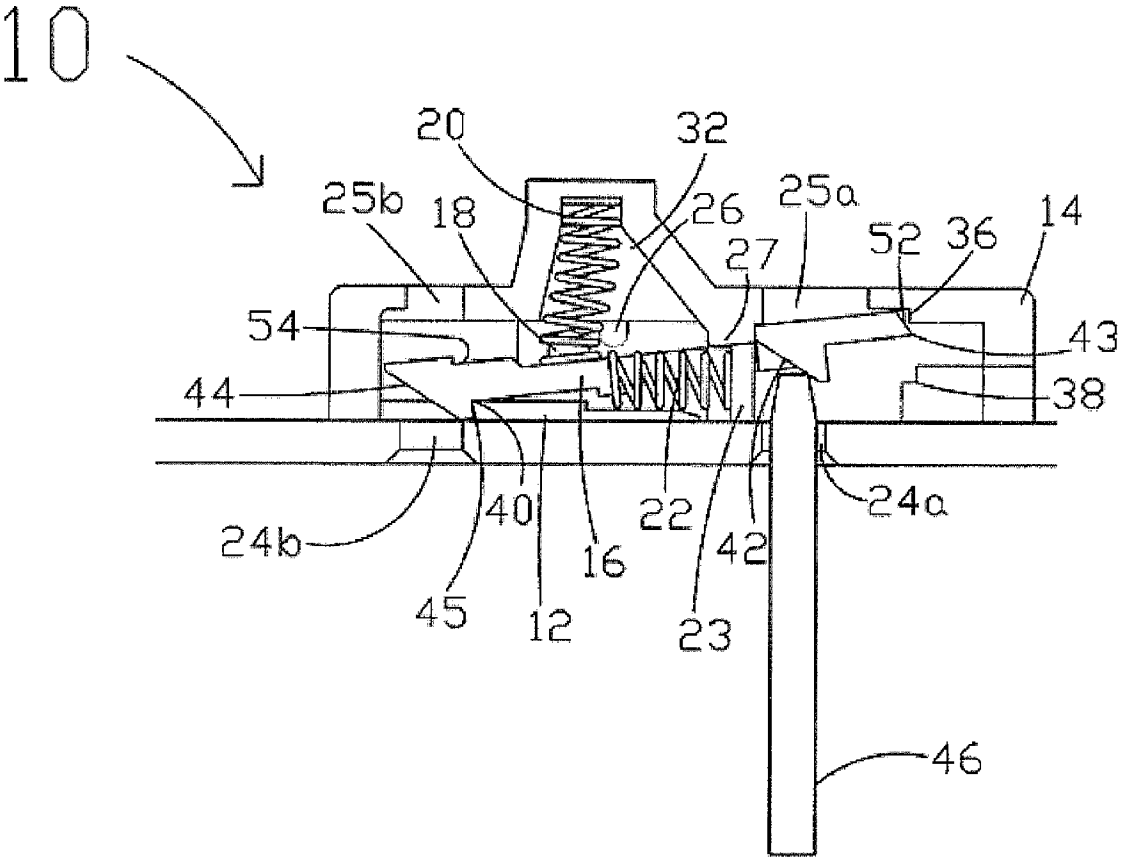
FIG. 13 shows a cutaway plan view of a shutter assembly with second pin inserted into the shutter assembly and two locks engaging to prevent an electrical connection according to an embodiment of the present invention and shows an example of the shutter in the first pivot position.

A similar operation may be seen in FIG. 11. In FIG. 11, the first pin 46 only is inserted into the first wall plate aperture 24*a*. In FIG. 11, as the first pin 46 extends through the first wall plate aperture 24*a*, the force exerted by the first pin 46 on the first angled surface 42 causes the shutter 16 to pivot about the dowel 18. Thus, although the first lug 43 is forced away from the first lock 38, the second lug 45 is forced to maintain its position against the second lock 40. The third lug 52 is then forced to the position against the third lock 36 as seen in FIG. 13. In this position, plate protrusions 27 provide a hard pivot point for shutter 16 that holds second lug 45 more securely against lock 40 as first pin 46 is pushed in with more force. Thus, the shutter 16 is prevented from moving laterally toward its open position. The shutter therefore prevents access to the first and second back plate apertures 25*a* and 25*b* respectively, and the receptacle.

Figure 14:
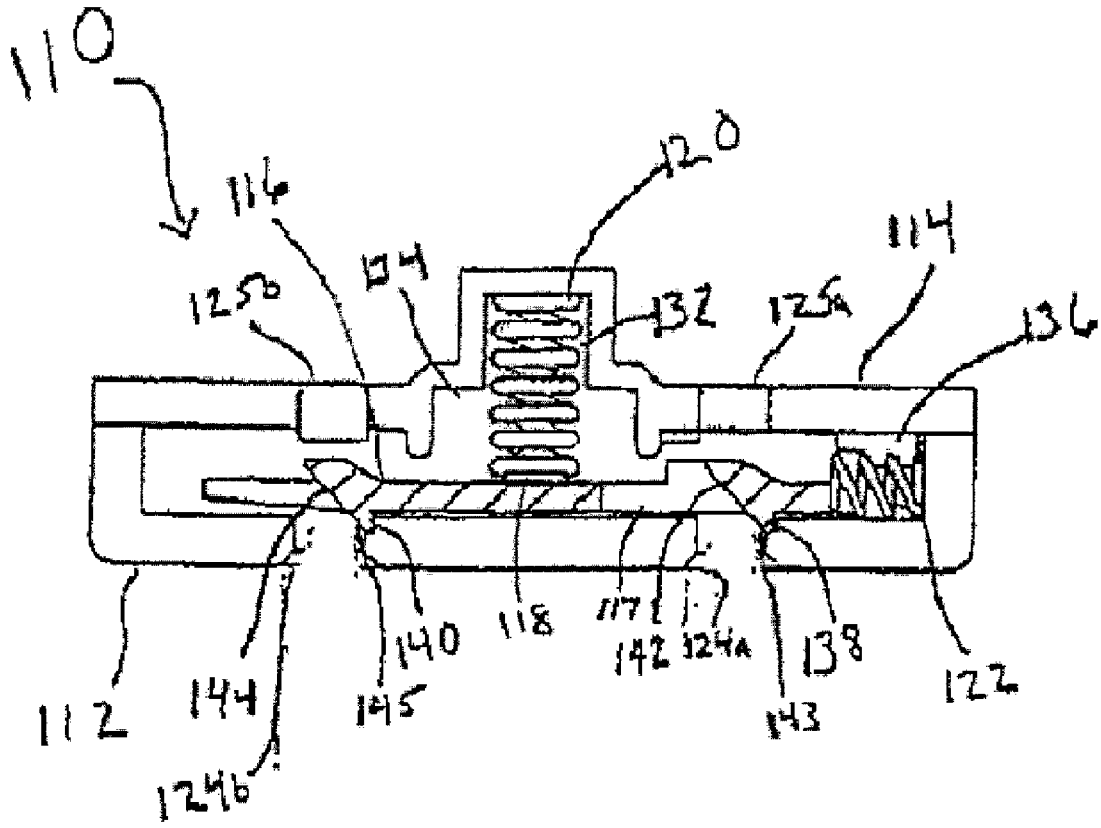
FIG. 14 shows a cutaway plan view of a shutter assembly where the shutter spring is located at another lug with respect to FIG. 1 through FIG. 13 according to another embodiment of the present invention.

A shutter assembly 110 according to another embodiment of the present invention is shown in FIG. 14. The shutter assembly 110 includes a card 112, a back plate 114, a shutter 116, a dowel 118, one or more dowel springs 120 and a shutter spring 122. The shutter spring 122 may be disposed between lug 143 or side of the shutter 116 and a side of the card 112. According to the embodiment of the present invention shown in FIG. 14, the shutter assembly 110 is used for a common household AC outlet.

The advantages of embodiments of the present invention may readily be seen. For example, both lugs keep the shutter locked into position against the card via the force exerted on it by the dowel spring via the dowel. Thus, the shutter assembly is in a "normally locked" position when there are no pins inserted into the shutter assembly. In other words, a shutter according to an example embodiment of the present invention rests normally in a locked position. No insertion is required to engage the locks. According to embodiments of the present invention, the dowel may provide a consistent force to the shutter so that the lugs remain in a locked position against the card when the apertures of the shutter assembly are closed.

Another advantage of embodiments of the present invention is that the contact surfaces, which generates friction when the shutter slides, can be very small as can be shown in FIG. 4. Thus, the friction between the shutter and the plate protrusions and the friction between the shutter and the card are minimal as the shutter moves laterally. As a result of low friction and low insertion force, when two pins, other than the ground pin, either sharp or round edges, are inserted into the shutter assembly, the shutter slides laterally smoothly. The angled surfaces will not wear out quickly even when plugs with relatively sharp edges are inserted into the socket.

Moreover, the unique design of embodiments of the present invention results in a shutter assembly having a relatively small thickness. A small thickness is desirable because the distance traveled through the assembly is minimized and contact between the plug and contact points on an opposite side of the assembly is superior. Furthermore, the present invention achieves a greater efficiency because it has less moving parts, leading to a smaller amount of malfunctions, and reduction in production costs and maintenance.

Furthermore, the unique design of embodiments of the present invention result in a shutter assembly that is an independent module. Meaning the shutter assembly may be attached to various cover plate designs. The shutter assembly is portable, interchangeable and therefore is not restricted to a particular cover plate. Hence an owner may change cover plate designs by extracting the shutter assembly from the old cover plate and installing the shutter assembly on a new cover plate.

While particular embodiments of the present invention have been shown and described, it will be obvious to those skilled in the art that the invention is not limited to the particular embodiments shown and described and that changes and modifications may be made without departing from the spirit and scope of the appended claims.

What is claimed is:

1. A shutter assembly for a receptacle comprising:

a back plate having at least one back plate aperture;

a front plate disposed adjacent to the back plate;

a shutter disposed between the back plate and the front plate, the shutter arranged to at least partially block the at least one aperture and being moveable to unblock the at least one back plate aperture;

at least one pivot structure on the shutter to define a fulcrum;

the shutter capable of pivoting about the fulcrum between a first pivot position and a second pivot position;

the shutter being moveable to unblock said at least one aperture in the second pivot position and the shutter locked from moving to the unblock position when the shutter is in the first pivot position; and first and second biasing members, the second biasing member arranged to bias the shutter away from the back plate, the second biasing member configured to allow transverse movement of the shutter; and the first biasing member to provide a bias force against lateral movement of the shutter.

2. The shutter assembly as recited in claim 1, wherein the first plate, the second plate and the shutter assemble to form a single unitary body.

3. The shutter assembly as recited in claim 1, wherein the at least one back plate aperture is configured to receive at least one pin of an electrical connector and wherein when the shutter is at the second pivot position, the shutter is configured to allow the at least one pin to extend through the at least one back plate aperture.

4. The shutter assembly as recited in claim 3, wherein when the shutter is in the first pivot position, the shutter is configured to block the at least one pin from extending through at least one back plate apertures.

5. The shutter assembly as recited in claim 1, wherein when the shutter is in the first pivot position, the shutter is configured to block the at least one pin from extending through at least one back plate apertures.

6. The shutter assembly as recited in claim 1, wherein the at least one back plate aperture is configured to receive at least one pin of an electrical connector and wherein the shutter pivots about the fulcrum when no more than one pin is inserted through the at least one back plate aperture against a surface of the shutter.

7. The shutter assembly as recited in claim 1, the shutter further comprises:

a first angled surface, a second angled surface;

the at least one aperture of the shutter disposed between the first angled surface and the second angled surface.

8. The shutter assembly as recited in claim 7, wherein when a plurality of pins are inserted at the same time against the first angled surface and the second angled surface, the at least one aperture of the shutter align with the at least one aperture of the back plate.

9. The shutter assembly as recited in claim 7, wherein the shutter blocks the at least one aperture of the back plate when the shutter is in a first pivot position; and wherein the shutter remains in the first pivot position when a pin is inserted against no more than one of the angled surfaces of the shutter.

10. The shutter assembly as recited in claim 9, the front plate having a length and a width dimension; the width of the front plate allows the two pins of an AC plug to extend around the front plate.

11. A shutter assembly for a receptacle comprising:

a back plate having at least one back plate aperture;

a front plate disposed adjacent to the back plate;

a shutter disposed between the back plate and the front plate, the shutter arranged to at least partially block the at least one aperture and being moveable to unblock the at least one back plate aperture; and at least one pivot structure on the shutter to define a fulcrum;

a second biasing member arranged to bias the shutter away from the back plate;

the shutter capable of pivoting about the fulcrum between a first pivot position and a second pivot position;

the shutter being moveable to unblock at least one aperture in the second pivot position and the shutter locked from moving to the unblock position when the shutter is in the first pivot position; and wherein the second biasing member and the at least one pivot structure are configured to provide a pivot point to the shutter.

12. A shutter assembly for a receptacle comprising:

a back plate having at least one back plate aperture;

a front plate disposed adjacent to the back plate;

a shutter disposed between the back plate and the front plate, the shutter arranged to at least partially block the at least one aperture and being moveable to unblock the at least one back plate aperture; and at least one pivot structure on the shutter to define a fulcrum;

the shutter capable of pivoting about the fulcrum between a first pivot position and a second pivot position;

the shutter being moveable to unblock at least one aperture in the second pivot position and the shutter locked from moving to the unblock position when the shutter is in the first pivot position; and wherein the back plate further comprises a plurality of stop surfaces that inhibit the lateral movement of the shutter when the shutter is in the first pivot position.

13. A shutter assembly for a receptacle comprising:

a back plate having at least one back plate apertures configured to receive at least one pin of an electrical connector;

a front plate disposed adjacent to the back plate;

a shutter having at least one apertures, the shutter being disposed between the back plate and the front plate;

at least one pivot structure on the shutter;

the shutter configured to pivot about the pivot structure as a fulcrum and between a plurality of pivot positions including at least a first and a second pivot position;

the shutter configured to be moveable laterally from a first pivot position to a second pivot position to align the at least one shutter aperture with the at least one back plate aperture;

the shutter further comprising a plurality of stop surfaces that are configured to contact at least one of a plurality of stop surfaces of the back plate and a plurality of stop surfaces of the front plates when in the first pivot position;

wherein when the plurality of stop surfaces of the back plate or the front plate contact the plurality of stop surfaces of the shutter, the shutter inhibits a pin from extending through the at least two back plate apertures; and the shutter assembly further comprising first and second biasing members, the second biasing member arranged to bias the shutter away from the back plate, but to allow transverse movement of the shutter, and the first biasing member arranged to provide a bias force against lateral movement of the shutter.

14. A receptacle comprising:

a wall power outlet;

at least one electrical contact inside the wall power outlet;

a shutter assembly disposed between the electrical contacts and wall power outlet, the shutter assembly further comprising:

a back plate having at least one back plate aperture;

a front plate disposed adjacent to the plate;

a shutter disposed between the plate and the front plate;

at least one pivot structure on the shutter; and the shutter having at least one shutter aperture, the shutter capable of pivoting about the pivot structure as a fulcrum between a first pivot position and a second pivot position;

wherein when the shutter is at the second pivot position, the shutter is configured to allow at least one pin to extend through at least one back plate aperture;

wherein when the shutter is in the first pivot position, the shutter is configured to block the at least one pin from extending through at least one back plate apertures; and the shutter assembly further comprising first and second biasing members, the second biasing member arranged to bias the shutter away from the back plate, but to allow transverse movement of the shutter, and the first biasing member arranged to provide a bias force against lateral movement of the shutter.

15. A method of manufacturing a shutter assembly for a receptacle comprising:

providing a back plate having at least two apertures;

disposing a front plate adjacent the back plate;

disposing a shutter between the front plate and the back plate;

providing a pivot structure on the shutter;

providing a second biasing member that engages with the pivot structure and the back plate; to bias the shutter away from the back plate, but to allow transverse movement of the shutter, and arranging a first biasing member to provide a bias force against lateral movement of the shutter; and supporting the shutter for pivoting about the pivot structure as a fulcrum between a first pivot position and a second pivot position for the shutter wherein when the shutter is in a first pivot position the shutter blocks pins from extending through the at least two back plate apertures.

* * * * *